US009660329B2

(12) United States Patent
Lin et al.

(10) Patent No.: US 9,660,329 B2
(45) Date of Patent: May 23, 2017

(54) DIRECTIONAL ANTENNA

(71) Applicants: Ting-Yi Lin, Taipei (TW); Tsung-Hsun Hsieh, Taipei (TW); Chi-Hsien Chiu, Taipei (TW); Yu-Chia Chang, Taipei (TW)

(72) Inventors: Ting-Yi Lin, Taipei (TW); Tsung-Hsun Hsieh, Taipei (TW); Chi-Hsien Chiu, Taipei (TW); Yu-Chia Chang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 320 days.

(21) Appl. No.: 14/048,042

(22) Filed: Oct. 8, 2013

(65) Prior Publication Data

US 2014/0111399 A1 Apr. 24, 2014

Related U.S. Application Data

(60) Provisional application No. 61/715,307, filed on Oct. 18, 2012.

(30) Foreign Application Priority Data

Aug. 2, 2013 (CN) ..... 2013 1 0334918

(51) Int. Cl.
*H01Q 11/00* (2006.01)
*H01Q 1/36* (2006.01)
(Continued)

(52) U.S. Cl.
CPC ..... *H01Q 1/36* (2013.01); *H01Q 1/243* (2013.01); *H01Q 9/16* (2013.01)

(58) Field of Classification Search
CPC ..... H01Q 1/36; H01Q 19/30; H01Q 19/005; H01Q 1/246; H01Q 5/378
(Continued)

(56) References Cited

U.S. PATENT DOCUMENTS

2001/0043157 A1* 11/2001 Luk ..... H01Q 1/40 343/700 MS
2005/0156787 A1* 7/2005 Myoung ..... H01Q 1/38 343/700 MS (Continued)

FOREIGN PATENT DOCUMENTS

| | | |
|---|---|---|
| CN | 102122751 | 7/2011 |
| CN | 102738555 | 10/2012 |
| TW | 201134008 | 10/2011 |

OTHER PUBLICATIONS

AntennaFrequencyScalingTheARRLAntennaBook1988pp2-24to2-25.*

"Office Action of China Counterpart Application", issued on May 25, 2015, p. 1-p. 7, in which the listed references were cited.

*Primary Examiner* — Graham Smith
*Assistant Examiner* — Collin Dawkins
(74) *Attorney, Agent, or Firm* — Jianq Chyun IP Office

(57) ABSTRACT

A directional antenna including a ground plane, a feeding element and a radiating element is provided. The feeding element is adjacent to the ground plane and includes a feeding point. A coupling gap is formed between the radiating element and the feeding element, and the radiating element includes a coupling point. Both the coupling point of the radiating element and the feeding point of the feeding element are at the perpendicular line of a ground plane. Further, a distance between the coupling point and an open end of the radiating element is smaller than 0.16λ of a resonant frequency of the directional antenna.

6 Claims, 4 Drawing Sheets

(51) Int. Cl.
*H01Q 1/24* (2006.01)
*H01Q 9/16* (2006.01)

(58) Field of Classification Search
USPC ..... 343/843, 834, 835, 815, 813
See application file for complete search history.

(56) References Cited

U.S. PATENT DOCUMENTS

| | | | | |
|---|---|---|---|---|
| 2012/0001815 | A1* | 1/2012 | Wong ..... | H01Q 1/243<br>343/749 |
| 2012/0313834 | A1 | 12/2012 | Eom et al. | |
| 2013/0135150 | A1 | 5/2013 | Kenoun et al. | |

* cited by examiner

DIRECTIONAL ANTENNA

CROSS-REFERENCE TO RELATED APPLICATION

This application claims the priority benefits of U.S. provisional application Ser. No. 61/715,307, filed on Oct. 18, 2012, and CN application serial No. 201310334918.5, filed on Aug. 12, 2013. The entirety of each of the above-mentioned patent applications is hereby incorporated by reference herein and made a part of this specification.

BACKGROUND OF THE INVENTION

Field of the Invention

The invention relates to an antenna and, more particularly to a directional antenna.

Description of the Related Art

An antenna is an important electronic component in a communication device or a handheld device. Since light, small and thin dimension of the communication device or the handheld devices are welcomed nowadays, the space for the antenna is thus limited.

A planar inverted-F antenna (PIFA antenna) and a monopole antenna are usually common used recently, radiation features of the two antennas are unidirectional, and a radiating pattern is difficult to be changed. In order to meet the requirements of directional features, the antenna needs to be adjusted repeatedly, which increases the time in designing antenna.

BRIEF SUMMARY OF THE INVENTION

A directional antenna is disclosed herein, and a radiation feature of the directional antenna is that it includes a directional and uniform radiating pattern. In addition, the directional antenna has the advantages of miniaturization and simple design. Therefore, the time and manufacture cost in designing antenna is reduced.

The directional antenna of the disclosure includes a ground plane, a feeding element and a radiating element. The feeding element is adjacent to the ground plane and includes a feeding point. A coupling gap is formed between the radiating element and the feeding element, and the radiating element includes a coupling point. Both the coupling point of the radiating element and the feeding point of the feeding element are at the perpendicular line of a ground plane. Further, a distance between the coupling point and an open end of the radiating element is smaller than 0.16λ of a resonant frequency of the directional antenna.

In the disclosure, feeding signals from the feeding element are coupled to the radiating element through a coupling gap, and the distance between the coupling point of the radiating element and an open end of the radiating element is smaller than 0.16λ of the resonant frequency of the directional antenna. Thus, the directional antenna includes a directional and uniform radiating pattern with small size and simple design. Furthermore, the time and manufacture cost in designing the antenna are also reduced.

These and other features, aspects and advantages of the present disclosure will become better understood with regard to the following description, and accompanying drawings.

DETAILED DESCRIPTION OF THE EMBODIMENTS

Figure 1:
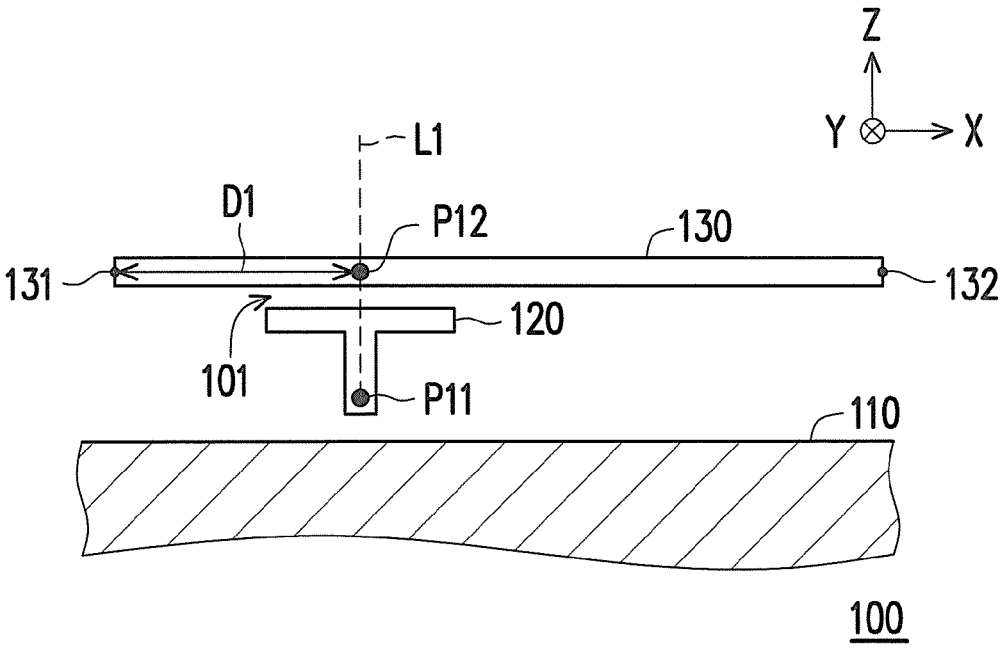
FIG. 1 is a schematic diagram showing the structure of a directional antenna in a first embodiment.

FIG. 1 is a schematic diagram showing the structure of a directional antenna in a first embodiment. Please refer to FIG. 1, a directional antenna 100 includes a ground plane 110, a feeding element 120 and a radiating element 130. The feeding element 120 is adjacent to the ground plane 110 and includes a feeding point P11. A coupling gap 101 is formed between the radiating element 130 and the feeding element 120. The feeding element 120 receives a feeding signal via the feeding point P11. In addition, the feeding signal is coupled to the radiating element 130 through the coupling gap 101 to excite the radiating element 130. Thus, the directional antenna 100 generates a resonant mode to operate at a resonant frequency.

The radiating element 130 includes a coupling point P12. The coupling point P12 of the radiating element 130 is relative to the feeding point P11 of the feeding element 120. For example, the coupling point P12 of the radiating element 130 and the feeding point P11 of the feeding element 120 are at a same perpendicular line L1, and the perpendicular line L1 is perpendicular to the ground plane 110. In other words, the intersection of the perpendicular line L1 and the radiating element 130 is the coupling point P12, the perpendicular line L1 extends from the feeding point P11 to the ground plane 110 along the perpendicular direction. Further, the radiating element 130 includes two open ends 131 and 132, and the coupling point P12 is adjacent to the open end 131 and far away from the open end 132.

Figure 2:
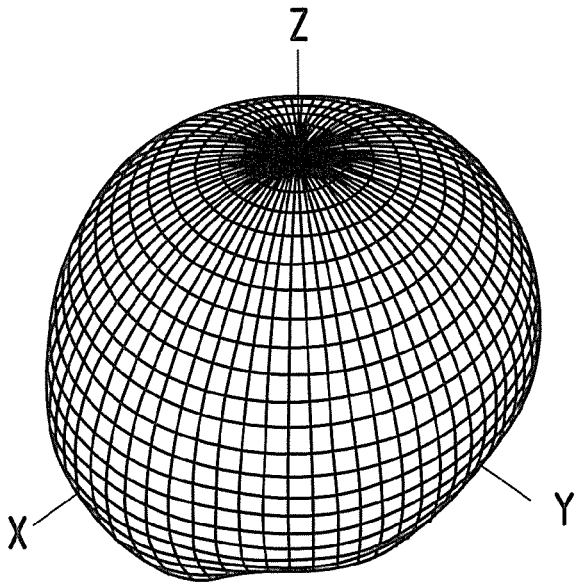
FIG. 2 is a diagram showing a radiating pattern of the directional antenna in FIG. 1 in an embodiment.

In addition, in the first embodiment, a distance D1 from the coupling point P12 of the radiating element 130 to an open end 131 is smaller than 0.16λ of a resonant frequency of the directional antenna 100. Thus, the directional antenna 100 has the radiation feature which is similar with that the patch antenna operates at the ½λ. Consequently, the directional antenna 100 has a better radiating pattern, and the radiation electric field of the directional antenna 100 is uniformly distributed in a direction perpendicular to the ground plane 110. For example, FIG. 2 is a diagram showing a radiating pattern of the directional antenna in FIG. 1 in an embodiment. As shown in FIG. 2, the radiating pattern of the directional antenna 100 centralizes towards +z direction and uniformly covers the upper part of the ground plane 110.

Additionally, according to this structure, the length of the radiating element 130 is about ⅓ A of the resonant frequency of the directional antenna 100, which helps to reduce the size of the directional antenna 100. Furthermore, the radiation feature of the directional antenna 100 is not easily affected by the size of the ground plane 110 and surrounding environments. Moreover, as long as the distance D1 from the coupling point P12 of the radiating element 130 to the open end 131 is smaller than 0.16λ of the resonant frequency of the directional antenna 100, the directional antenna 100 would have a better directional radiating pattern. Additionally, the directional antenna 100 would have better impedance matching by adjusting the shape, the length of the feeding element 120 and the coupling gap 101. Consequently, the directional antenna 100 shown in FIG. 1 has a directional feature via the simple design to meet demands on the communication application and greatly reduce the time in designing the antenna.

Moreover, as shown in FIG. 1, the feeding element 120 and the radiating element 130 are arranged at a side of the ground plane 110 along the direction perpendicular to the ground plane 110 (such as the z-direction). Additionally, the feeding element 120 includes a segment which is generally parallel to the radiating element 130, and the coupling gap 101 is formed between the radiating element 130 and the segment. Furthermore, the feeding element 120 and the radiating element 130 are at the same horizontal plane (such as the x-z plane). That is, the directional antenna 100 includes a plane structure, which helps to reduce the manufacturing cost of the directional antenna 100 and facilitates the integration of the directional antenna 100 and a cambered surface structure of the device. On the other hand, the ground plane 110, the feeding element 120 and the radiating element 130 can be bent adaptively corresponding to the application environment to make the directional antenna 100 form a required stereoscopic structure for the hardware space by folding.

In addition, since the coupling point P12 of the radiating element 130 is relative to the feeding point P11 of the feeding element 120, the coupling point P12 moves correspondingly with the change of the configuration position of the feeding point P11. That is, when the feeding element 120 moves relative to the radiating element 130 along +x direction or −x direction, the coupling point P12 of the radiating element 130 also moves along +x direction or −x direction. Therefore, in practical application, persons having ordinary skill in the art can adjust the relative position of the feeding element 120 and the radiating element 130 according to the design requirements, so as to adjust the configuration position of the coupling point P12 of the radiating element 130.

Figure 3:
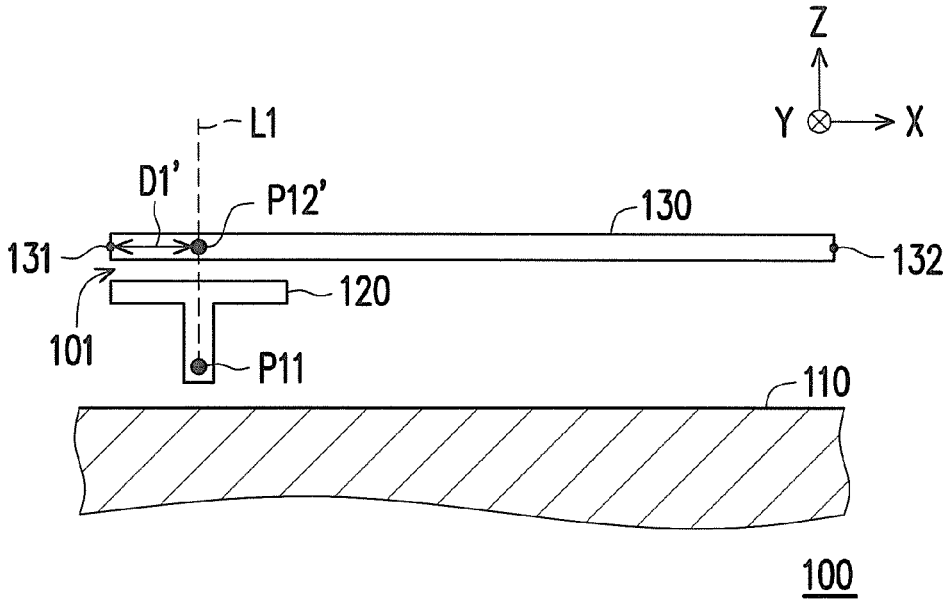
FIG. 3 is a schematic diagram showing the structure of a directional antenna in a second embodiment.

For example, when the configuration position of the feeding element 120 shown in FIG. 1 moves relative to the radiating element 130 along −x direction, the coupling point of the radiating element 130 is shown as P12' in FIG. 3. Additionally, as the configuration position of the feeding element 120 changes, the distance between the coupling point P12'of the radiating element 130 and the open end 131 is shown as D1'. Both the distance D1 in FIG. 1 and the distance D1' in FIG. 3 are smaller than 0.16λ of the resonant frequency of the directional antenna, which makes the directional antenna 100 have a better directional radiating pattern. In other words, in practical application, under the condition that the distance between the coupling point and the open end is smaller than 0.16λ of the resonant frequency of the directional antenna, the relative position of the feeding element 120 and the radiating element 130 can be adjusted.

Figure 4:
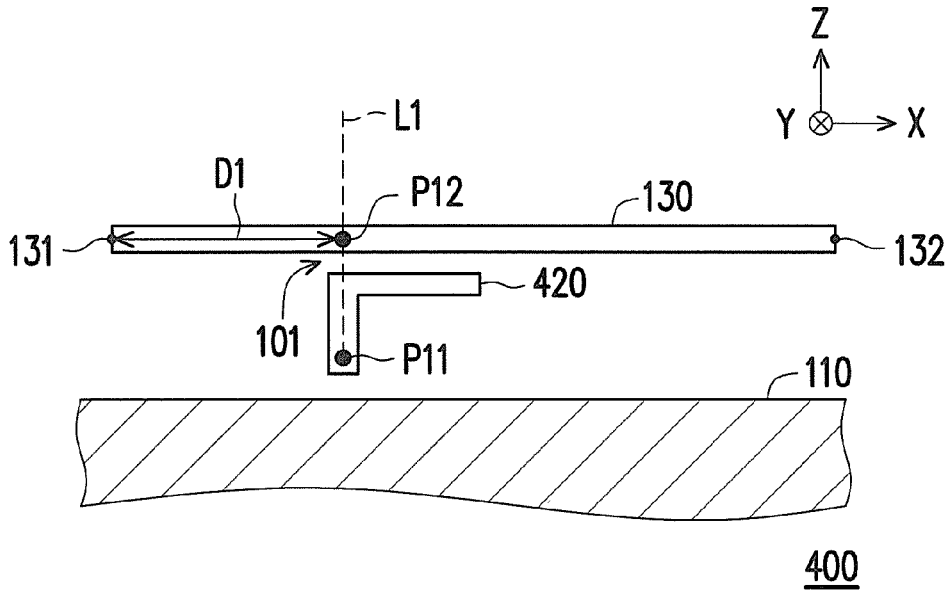
FIG. 4 is a schematic diagram showing the structure of a directional antenna in a third embodiment.

The feeding element 120 as shown in FIG. 1 is a T-shape sheet metal conductor, which is not limited herein. That is, the shape of the feeding element 120 also may be any other shapes, such as T-shape, L-shape, triangle, rectangle or other geometrical shapes. For example, FIG. 4 is a schematic diagram showing the structure of a directional antenna in another embodiment. The radiation feature of the directional antenna 400 shown in the FIG. 4 is similar to that of the directional antenna 100 shown in FIG. 1.

Figure 5:
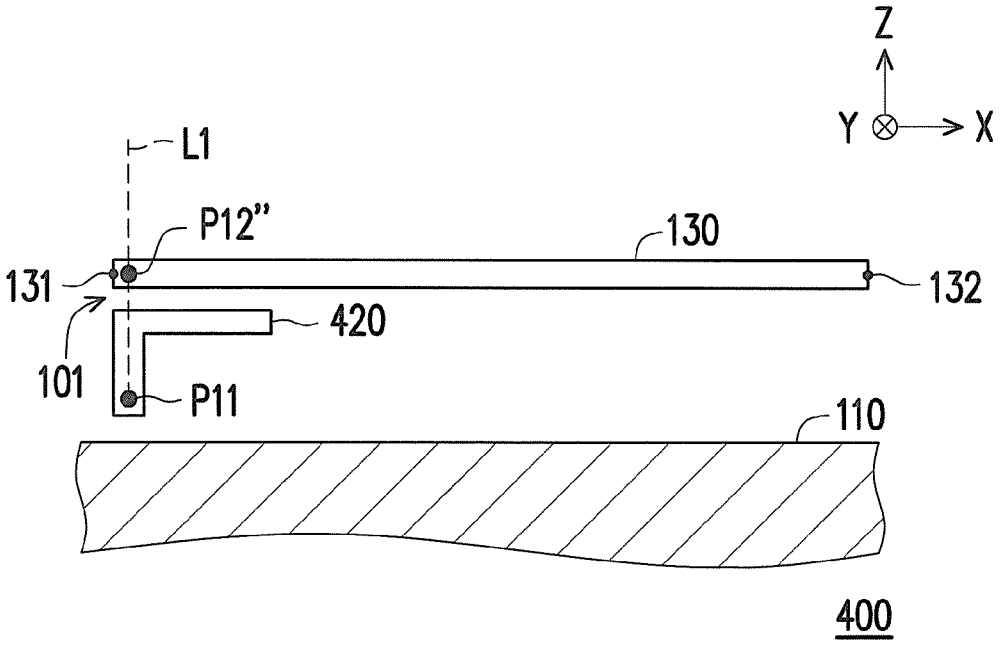
FIG. 5 is a schematic diagram showing the structure of a directional antenna in a fourth embodiment.

In detail, the feeding element 420 in FIG. 4 is an L-shape sheet metal conductor, which is different from FIG. 1. In addition, the feeding element 420 includes a segment which is parallel to the radiating element 130, and the coupling gap 101 is formed between the radiating element 130 and the segment. Moreover, when the configuration position of the feeding element 420 in FIG. 4 moves relative to the radiating element 130 along the −x direction, the coupling point of the radiating element 130 is shown as P12" in FIG. 5. Furthermore, as the configuration position of the feeding element 420 changes, the distance between the coupling point P12"of the radiating element 130 and the open end 131 is close to zero. The other detail structures of the directional antenna 400 in FIG. 4 to FIG. 5 are similar to the above embodiments, which are omitted herein for a concise purpose.

Furthermore, the radiating element 130 in the above embodiments is a strip-shaped metal conductor, which is not limited herein. For example, persons having ordinary skill in the art can dispose at least a bending structure at the radiating element 130. Thus, the radiating element 130 can change into different geometric shapes via at least a bending structure.

Figure 6:
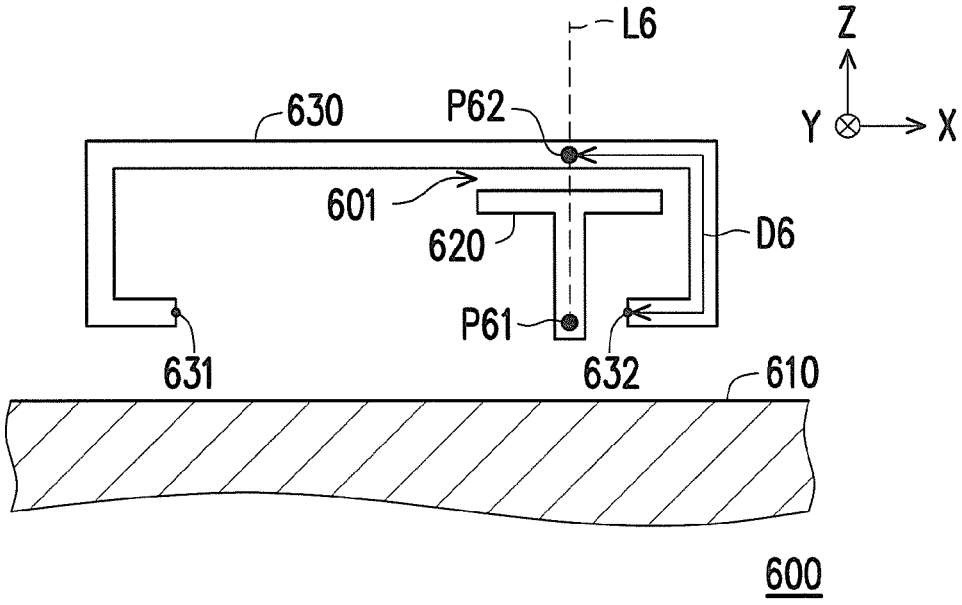
FIG. 6 is a schematic diagram showing the structure of a directional antenna in a fifth embodiment.

For example, FIG. 6 is a schematic diagram showing the structure of a directional antenna in a fifth embodiment. As shown in FIG. 6, a directional antenna 600 includes a ground plane 610, a feeding element 620 and a radiating element 630. The feeding element 620 is adjacent to the ground plane 610 and includes a feeding point P61. A coupling gap 601 is formed between the radiating element 630 and the feeding element 620, and the radiating element 630 includes an open end 631 and an open end 632.

Additionally, the radiating element 630 further includes a coupling point P62. The coupling point P62 is adjacent to the open end 632 and far away from the open end 631. Both the coupling point P62 and the feeding point P61 are at the perpendicular line L6 of ground plane 610, and a distance D6 from the coupling point P62 to the open end 632 of the radiating element is smaller than 0.16λ of a resonant frequency of the directional antenna 600. Further, the length of the radiating element 630 is smaller than ⅓λ of the resonant frequency of the directional antenna 600.

Furthermore, the feeding element 620 and the radiating element 630 are arranged at one side of the ground plane 610 along a direction perpendicular to the ground plane 610 (such as the z-direction). In addition, the feeding element 620 and the radiating element 630 are at the same horizontal plane (such as the x-z plane). On the other hand, the ground plane 610, the feeding element 620 and the radiating element 630 can be bent adaptively to make the directional antenna 600 forms a required stereoscopic structure for the hardware space by folding. The feeding element 620 receives a feeding signal via the feeding point P61. In addition, the feeding signal is coupled to the radiating element 630 through the coupling gap 601. Thus, the directional antenna 600 generates a resonant mode to operate at a resonant frequency, and the radiating pattern of the directional antenna 600 is uniformly distributed in the direction perpendicular to the ground plane 610.

Furthermore, the feeding element 620 may be a T-shape metal conductor, and the radiating element 630 may be a strip-shaped metal conductor. Additionally, the radiating element 630 includes a plurality of bending structures around the feeding element 620. The feeding element 620 and the radiating element 630 are not limited to those shown in FIG. 6. For example, the shape of the feeding element 620 also may be any other shape, such as L-shape, triangle, rectangle or other geometrical shapes, and the radiating element 630 can change into different geometric shapes via at least a bending structure, which is not limited herein.

Figure 7:
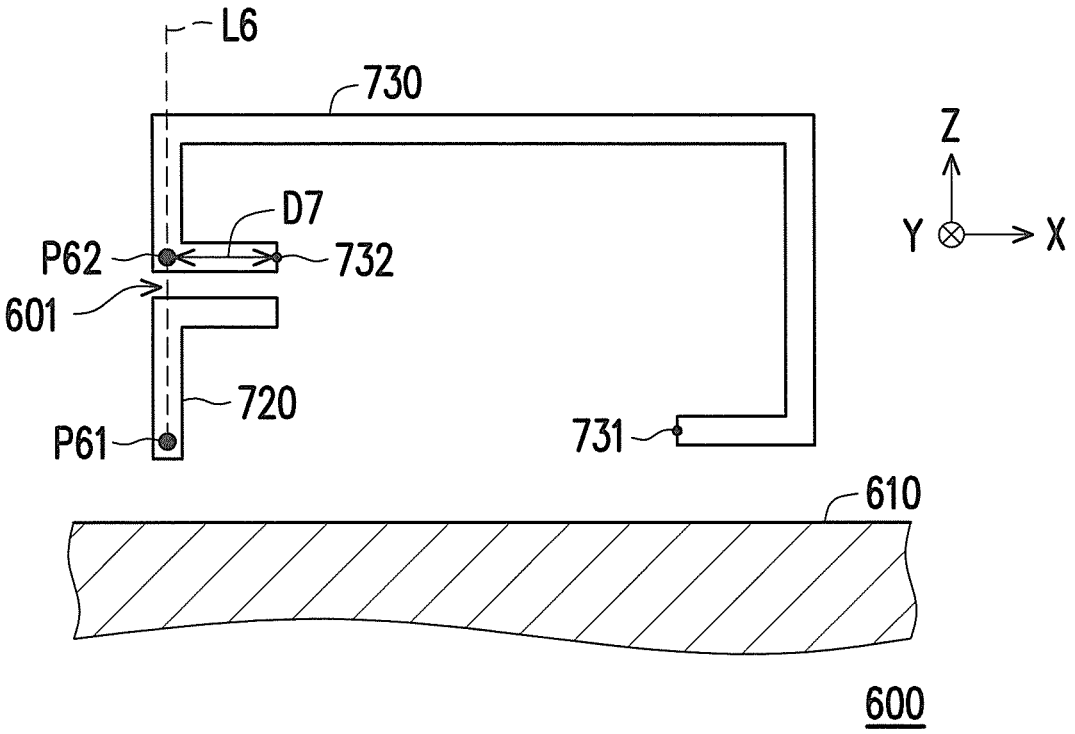
FIG. 7 is a structure diagram showing a directional antenna in a sixth embodiment.

For example, FIG. 7 is a structure diagram showing a directional antenna in a sixth embodiment. Similar to the embodiment in FIG. 6, the coupling gap 601 is formed between a feeding element 720 and a radiating element 730, and the radiating element 730 includes two open ends 731, 732. Furthermore, both the feeding point P61 of the feeding element 720 and the coupling point P62 of the radiating element 730 are at the perpendicular line L6, and a distance D7 between the coupling point P62 and an open end 732 of the radiating element 730 is smaller than 0.16λ of the resonant frequency of the directional antenna 600.

On the other hand, the feeding element 720 in FIG. 7 is an L-shape metal conductor, which is different from the embodiment in FIG. 6. Additionally, viewing from the open end 732 of the radiating element 730, the radiating element 730 is bent along the clockwise direction through a plurality of the bending structures to make the radiating element 730 around the upper side and the right side of the feeding element 720. The other detail structures of the directional antenna 600 in FIG. 6 to FIG. 7 are illustrated in the above embodiments, which are omitted herein for a concise purpose.

In conclusion, feeding signals from the feeding element are coupled to the radiating element through the coupling gap, and the distance between the coupling point and the open end of the radiating element is smaller than 0.16λ of the resonant frequency of the directional antenna. Thus, the directional antenna has a better radiation feature, for example, the radiation feature is similar to that the patch antenna operates at the ½λ and the directional antenna can generate a radiating pattern uniformly covering the upper part of the ground plane. Moreover, the directional antenna has the advantage of miniaturization, which can reduce the time and manufacture cost of the antenna. Furthermore, the directional antenna also helps to the integration of the antenna and a cambered surface structure or a stereoscopic structure of the device.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A directional antenna, comprising:

a ground plane;

a planar feeding element including a feeding point and adjacent to the ground plane; and a planar radiating element including a coupling point, wherein the ground plane, the planar feeding element and the planar radiating element are disposed on a same horizontal plane, a coupling gap is formed between the planar radiating element and the planar feeding element, both the coupling point and the feeding point are at a perpendicular line of the ground plane, the planar radiating element is electrically disconnected from the ground plane, the directional antenna operates at a resonant frequency, a distance between the coupling point and an open end of the planar radiating element is smaller than 0.16λ of the resonant frequency of the directional antenna, and a radiating pattern of the directional antenna centralizes towards a direction perpendicular to an edge of the ground plane and parallel to the horizontal plane.

2. The directional antenna according to claim 1, wherein the planar feeding element receives a feeding signal through the feeding point, and the feeding signal is coupled to the planar radiating element through the coupling gap.

3. The directional antenna according to claim 1, wherein the planar feeding element and the planar radiating element are arranged at a side of the ground plane along a direction perpendicular to the ground plane.

4. The directional antenna according to claim 1, wherein the planar radiating element is a strip-shaped metal conductor or the planar radiating element is a metal conductor including at least a bending structure.

5. The directional antenna according to claim 1, wherein the planar feeding element includes a segment, and the segment is parallel to the planar radiating element, the coupling gap is formed between the planar radiating element and the segment.

6. The directional antenna according to claim 1, wherein length of the planar radiating element is ⅓ λ of the resonant frequency of the directional antenna.

* * * * *